US012325057B2

(12) United States Patent
Jansen et al.

(10) Patent No.: US 12,325,057 B2
(45) Date of Patent: Jun. 10, 2025

(54) CLAMPING SYSTEM FOR A PRESS BRAKE HAVING A FIRST BIASING MEANS ACTING ON AN ACTUATING MEMBER AND PRESS BRAKE COMPRISING SUCH A CLAMPING SYSTEM

(71) Applicant: WILA B.V., Lochem (NL)

(72) Inventors: Thomas Jan Herbert Jansen, Markelo (NL); Dennis Hermanus Johannes Rouhof, Harbrinkhoek (NL)

(73) Assignee: WILA B.V., Lochem (NL)

( * ) Notice: Subject to any disclaimer, the term of this patent is extended or adjusted under 35 U.S.C. 154(b) by 199 days.

(21) Appl. No.: 18/017,536

(22) PCT Filed: Jul. 16, 2021

(86) PCT No.: PCT/NL2021/050448

§ 371 (c)(1),
(2) Date: Jan. 23, 2023

(87) PCT Pub. No.: WO2022/019753

PCT Pub. Date: Jan. 27, 2022

(65) Prior Publication Data

US 2023/0264245 A1 Aug. 24, 2023

(30) Foreign Application Priority Data

Jul. 24, 2020 (NL) ..... 2026128

(51) Int. Cl.
*B21D 5/02* (2006.01)

(52) U.S. Cl.
CPC ..... *B21D 5/0245* (2013.01)

(58) Field of Classification Search
CPC ... B21D 5/0245; B21D 5/0236; B21D 5/0209
See application file for complete search history.

(56) References Cited

U.S. PATENT DOCUMENTS 6,516,649 B1 2/2003 Mika
2006/0174679 A1 8/2006 Pabich
(Continued)

FOREIGN PATENT DOCUMENTS

EP 3311931 A1 4/2018
EP 3501681 A1 * 6/2019 ..... B21D 5/0245
(Continued)

OTHER PUBLICATIONS

International Search Report and Written Opinion for the International Patent Application No. PCT/NL2021/050448, mailed Oct. 1, 2021, 13 pages.

*Primary Examiner* — Debra M Sullivan
(74) *Attorney, Agent, or Firm* — KDW Firm PLLC

(57) ABSTRACT

A clamping system for a press brake includes an elongate beam having a receiving space for receiving a part of a bending tool and a clamping element. The clamping element is movable between a first position, in which it may engage on the bending tool for clamping it in the receiving space, and a second position for releasing the bending tool. The system includes an actuating member for displacing the clamping element, the actuating member being movable between an active position in which it urges the clamping element towards the first position, and an inactive position in which it allows the clamping element to move to the second position. The clamping system includes a first biasing member acting on the actuating member for biasing the actuating member towards its inactive position. A press brake including such a clamping system.

20 Claims, 17 Drawing Sheets

(56) References Cited

U.S. PATENT DOCUMENTS

| | | | |
|---|---|---|---|
| 2006/0191313 | A1 | 8/2006 | Harrington |
| 2018/0133774 | A1 | 5/2018 | Hilton |

FOREIGN PATENT DOCUMENTS

| | | | | | |
|---|---|---|---|---|---|
| GB | 2057047 | A | * | 3/1981 | ..... B21D 5/0209 |
| JP | 857199523 | A | | 12/1982 | |
| JP | 2020006394 | A | | 1/2020 | |
| WO | 2010056110 | A1 | | 5/2010 | |
| WO | 2012145781 | A1 | | 11/2012 | |
| WO | 2020225761 | A1 | | 11/2020 | |

* cited by examiner

CLAMPING SYSTEM FOR A PRESS BRAKE HAVING A FIRST BIASING MEANS ACTING ON AN ACTUATING MEMBER AND PRESS BRAKE COMPRISING SUCH A CLAMPING SYSTEM

CROSS-REFERENCE TO RELATED APPLICATIONS

This application is a national stage filing under 35 U.S.C. 371 of pending International Application No. PCT/NL2021/050448, filed Jul. 16, 2021, which claims priority to Netherlands Patent Application No. 2026128, filed Jul. 24, 2020, the entirety of which applications are incorporated by reference herein.

TECHNICAL FIELD

The invention relates to a clamping system for a press brake, the clamping system comprising an elongate beam comprising a receiving space for receiving a part of a bending tool, a clamping element, the clamping element being movable between a first position, in which it may engage on the bending tool for clamping it in the receiving space, and a second position for releasing the bending tool, and an actuating member for displacing the clamping element, the actuating member being movable between an active position, in which it urges the clamping element towards the first position, and an inactive position in which it allows the clamping element to move to the second position.

BACKGROUND

Press brakes are machines used for bending or folding sheet material, such as metal sheets. For that purpose, press brakes include a bottom beam and a top beam, which are movable with respect to each other. The top and bottom beams both hold tools, between which a workpiece is provided for bending. In general, bending tools of a press brake are exchangeable to allow making different types of bends or folds, and to allow servicing the tools. Therefore, press brakes are provided with a clamping system which can releasably clamp the tools. Clamping systems may be provided on the top beam of the press brake, on the bottom beam, or on both.

Two types of press brakes can be distinguished. The first type has a clamping system that is an integral part of either the top or bottom beam. A further clamping system may or may not be provided for the other of the top or bottom beam. Such a clamping system, that is an integrated one, can not be detached from its top or bottom beam, and is itself thus not exchangeable with another clamping system, whereas the tools the clamping system can hold are exchangeable. The second type has an exchangeable clamping system that can be fixedly connected to either the top beam or the bottom beam. A further clamping system may or may not be provided for the other of the top or bottom beam. The exchangeable clamping system allows exchanging tools, but can also be detached from its top or bottom beam, for instance for maintenance or for exchanging it for another clamping system. This is in the art used to make one press brake suitable for different tooling types, which may require different clamping systems, and/or to service the clamping system.

Further clamping systems exist that can be clamped by other clamping systems as if they were a tool. Such clamping systems can for instance be clamped by a system for tools of a first type, whereas they themselves can clamp tools of a second type, so that such clamping systems act as an adaptor between a clamping system and a tool that would otherwise be incompatible.

SUMMARY

The invention relates to clamping systems integrated with press brakes, be it in the bottom beam or top beam, exchangeable clamping systems, and clamping systems acting as an adaptor.

A press brake and a clamping system therefor are known, for instance from applicant's earlier application WO 2010/056110 A1, which describes a clamping device for clamping a tool. The clamping device includes an actuated member and an engaging member. The actuated member is driven for instance hydraulically or pneumatically.

Although the clamping device described in WO 2010/056110 A1 has performed satisfactory, and to this day still does, a need exists to further improve the clamping device. This need exists in particular in relation to the time needed to change tools, since by decreasing the time needed to change tools, the press brake could be used more efficiently.

Therefore, the invention aims to provide a clamping system that can be operated more efficiently.

According to the invention, this aim is achieved by a clamping system for a press brake according to the preamble, characterized by a first biasing member acting on the actuating member for biasing the actuating member towards its inactive position.

The applicant has found that a relatively large part of the time needed for changing tools is taken up by displacing the clamping element towards its second position, in order to release the tool. To move the clamping element towards its second position, for instance in the case of the actuating member being pneumatically or hydraulically driven, pneumatic or hydraulic pressure on the actuating member needs to be stopped, and pneumatic or hydraulic fluid may need to flow back, to allow the actuating member to return to its inactive position. It may however take up to over ten seconds for the pneumatic or hydraulic fluid to have receded sufficiently for releasing the tool. To facilitate the pneumatic or hydraulic fluid receding, a first biasing member is provided that acts on the actuating member. The biasing member biases the actuating member to its inactive position, thereby forcing out pneumatic or hydraulic fluid upon sufficient release of pneumatic or hydraulic pressure. As a result, the time needed to move the actuating member back to its inactive position, and thus for allowing release of the tool, can be shortened, for instance to a period of approximately one to two seconds.

The first biasing member may of course also be used to perform a similar function when drive means other than pneumatic or hydraulic drive means are used.

It is noted that the first biasing member acting on the actuating member, instead of for instance on the clamping element, may provide a relatively large space for the first biasing member. In particular, a first biasing member acting on the actuating member may be relatively long and/or relatively wide. Accordingly, the first biasing member may therefore be relatively large, which in the case of e.g. a compression spring allows for a relatively high spring constant, so that the compression spring may provide a relatively large biasing force, which aids in reducing the time needed to move the actuating member. The length of the spring may also or alternatively allow a relatively large range of motion of the actuating member while being biased by the spring.

The relatively large range of motion of the actuating member may be of particular importance in cases where a relatively large stroke of the clamping element is needed. Clamping systems exist that include a protrusion acting as a hanger or hook on the inside of the receiving space, upon which a tool can be supported and/or hung. Since the tool needs sufficient space inside the receiving space to maneuver it around the protrusion for inserting or removing the tool, the receiving space is relatively broad as compared to the tool. Such clamping systems require a relatively large stroke of the clamping element, since the clamping element must traverse at least partly the relatively broad receiving space.

It is noted that a force provided by the first biasing member may need to be overcome to move the actuating member to its active position. Thus, the total force needed to clamp a tool is increased by the first biasing member. This can be achieved by selecting suitably strong drive means, such as hydraulic or pneumatic drive means, to drive the actuating member.

The first biasing member acting on the actuating member may herein be understood as that the first biasing member acts first on the actuating member. Of course, the actuating member may in that case act for instance on the clamping element or for instance drive means. It must be understood that biasing means acting first on for instance the clamping element, whilst the clamping element acts on the actuating member, are not herein understood to act on the actuating member. Accordingly, the first biasing member may act on the actuating member directly.

The first biasing means may act on any element that moves in the same direction and with the same speed as the actuating member, e.g. any element that is fixedly connected to the actuating member.

In an embodiment of the clamping system, the clamping system having a pressing direction, the first biasing member is arranged substantially parallel to the pressing direction. The first biasing member may as such be arranged vertically.

Having the biasing member substantially parallel to the pressing direction allows for a relatively compact construction of the press brake. In particular, the first biasing member could be arranged at least partly along the receiving space. Additionally or alternatively, this embodiment allows using a relatively long first biasing member in a relatively small, in particular relatively narrow, elongate beam.

Providing a compact construction may aid in reducing a risk of a workpiece colliding with the press brake. As an example, when a workpiece is to be bent multiple times, for instance in different locations, it may fold back towards the elongate beam. The elongate beam could in that case limit the size of the workpiece and/or the amount of bends that can be made in the workpiece, before the elongate beam blocks the workpiece while bending. As such, compactly constructing the press brake is important to allow as much room for the workpiece as possible, so that complex geometries, with many fold, and/or relatively large workpieces may be bent using the press brake.

These advantages could be achieved in a press brake according to the preamble of claim 1, characterized in that the press brake defines a pressing direction, wherein the first biasing member is arranged substantially parallel to the pressing direction. Thus, when the first biasing member is arranged substantially parallel to the pressing direction, the first biasing member need not in all cases act on the actuating member.

The pressing direction is understood as the direction in which a tool clamped by the clamping system is moved with respect to another tool in order to bend a workpiece. The pressing direction may correspond to a depth direction of the receiving space. The pressing direction may be vertical.

In another embodiment of the clamping system, the actuating member is movable in a direction substantially parallel to the pressing direction between its active and inactive position.

When the actuating member is movable substantially parallel to the pressing direction, drive means for driving the actuating member may be placed towards for instance the top or bottom of the actuating member instead of towards a side thereof. As such, such clamping system may be constructed relatively compactly. It is noted that when the elongate beam is a top beam, the drive means may be placed towards the top of the actuating member, whereas when the elongate beam is a bottom beam, the drive means may be placed towards the bottom of the actuating member.

In yet another embodiment of the clamping system the first biasing member extends at least partly in a first cavity in the actuating member, or extends at least partly around the actuating member.

Accordingly, the first biasing member is disposed either partly in or partly around the actuating member. As such, the first biasing member may be relatively long without requiring a relatively large accommodating space extending beyond the first biasing member. A relatively long first biasing member may in particular be useful for providing a biasing force over a relatively long movement path.

It is noted that the first biasing member extending at least partly around the actuating member should be interpreted as that the first biasing member surrounds the actuating member for at least a portion of the length of the first biasing member. Thus, the first biasing member encompasses a part of the actuating member at least partly. The first biasing member being merely arranged in the vicinity of the actuating member, is not understood to constitute the first biasing member extending around the actuating member.

Throughout this application, words denoting numerals, such as first, second, third etc. are used solely to distinguish between one and the other of something. Accordingly, the cavity in the actuating member being referred to as first cavity does not imply there are more cavities in the actuating member. Moreover, a second cavity does not necessarily have to be a cavity in the actuating member.

In yet another embodiment of the clamping system, the first biasing member is arranged on a side of the actuating member proximate the clamping element.

Placing the first biasing member proximate the clamping element allows the first biasing member to push the biasing member back to its inactive position. Moreover, this leaves free the distal end of the actuating member for drive means to engage on the actuating member.

In yet another embodiment of the clamping system, the clamping system comprises a first stop for limiting movement of the actuating member beyond its active position.

By limiting the movement of the actuating member, damage to the first biasing member, for instance by overly compressing them, may be prevented. Accordingly, the first stop may be separate from an engaging surface upon which the first biasing member is supported.

In yet another embodiment of the clamping system, the clamping element is movable in a direction substantially perpendicular to the pressing direction and to a longitudinal direction of the elongate beam between its first and second position. The clamping element may be movable horizontally.

This allows retracting the clamping element away from the receiving space to release the tool, towards a side of the elongate beam.

In yet another embodiment of the clamping system, the clamping system comprises a second biasing member acting on the clamping element, for biasing the clamping element towards the second position.

Biasing the clamping element to the second position ensures that the clamping element moves to the second position when the actuating member is moved to its inactive position, which aids in releasing a tool. Moreover, the second biasing member may aid the first biasing member in pushing back the actuating member, by providing a force directing the biasing member towards in its inactive position via the clamping element. Thus, the second biasing member aids in achieving the advantages described in relation to the first biasing member.

When the first and second biasing means are used together, a relatively large total biasing force may be generated, especially in a limited amount of space. Accordingly, the clamping system of this embodiment may be constructed relatively compactly.

It is noted that the first and/or second biasing member may comprise an elastically deformable element, that deforms upon movement of the actuating member or clamping element respectively, and provides an elastic force in the opposing direction for biasing the actuating member or clamping element respectively. Other suitable biasing means may be used alternatively, such as gas springs.

In yet another embodiment of the clamping system the second biasing member is arranged substantially perpendicular to the pressing direction and to a longitudinal direction of the elongate beam. The second biasing member may be arranged horizontally.

Arranging the second biasing member in this direction may aid in enabling a compact construction.

In yet another embodiment of the clamping system, the second biasing member extends at least partly in a second cavity in the elongate beam.

In this embodiment, the second biasing member may be relatively long, whilst allowing the elongate beam to be constructed relatively compactly. Accordingly, the second biasing member may have a relatively large range of motion. Moreover, if the second biasing member comprises a compression spring, arranging the spring at least partly in the second cavity allows selecting a suitable spring with a suitable spring constant.

Note that the cavity in the elongate beam is referred to as second cavity only to distinguish it from the cavity in the first biasing means, which is referred to as first cavity. There need not be additional cavities in the elongate beam, and the first and second cavity need not have anything in common apart from both being cavities.

In yet another embodiment of the clamping system, the clamping element comprises a protrusion for engaging the second biasing member.

Providing a protrusion for engaging the second biasing member allows placing the second biasing member adjacent to the clamping element, which may allow a particularly compact construction of the clamping system.

The second biasing member may extend substantially parallel to the clamping element.

In yet another embodiment of the clamping system, the clamping system further comprises a second stop for limiting movement of the clamping element beyond its second position.

Limiting the movement of the clamping element beyond the second position aids in preventing damage to the second biasing means, for instance by preventing overextension or overcompression thereof. Additionally or alternatively the second stop may aid in increasing reliability of the clamping system, by preventing jams that may occur when the clamping element moves beyond the second position.

In yet another embodiment of the clamping system the second stop engages the protrusion in the second position.

Using the protrusion to engage the second stop allows positioning the second stop transversally with respect to the clamping element, so that for instance the actuating member can be positioned in a space corresponding to a longitudinal extension of the clamping element.

In yet another embodiment of the clamping system, the clamping element comprises a recess for receiving at least part of the first biasing member.

The recess forms a cut-out into which the first biasing member may at least partly be received. As a result, the first biasing member and the clamping element may be placed relatively close to each other. In particular, in the second position of the clamping element, a surface of the clamping element for engaging the tool may be relatively close to the first biasing member. As such, the clamping member and the first biasing member together take up less space, allowing a relatively compact construction of the elongate beam.

When the first biasing member is received in the recess, the clamping element may extend at least partly around the first biasing member, i.e. the clamping element may partly surround the first biasing member. The clamping element extending at least partly around the first biasing member may allow the actuating member to engage on a part, e.g. a protrusion, of the clamping element which defines the recess and which in the second position of the clamping element protrudes up to or beyond the first biasing member. The protrusion may aid in providing a relatively large area upon which the actuating member may engage, whereas the recess allows a compact design of the protrusion and the first biasing element.

The recess can further act as a guide for the first biasing member.

In yet another embodiment of the clamping system the first or the second biasing member comprises a compression spring. The recess may therefore correspond to a cylindrical shape of the biasing member.

The applicant has found that using a compression spring allows reliable performance of the clamping system. Moreover, a compression spring can provide sufficient biasing force and requires no external activation.

It should be noted that when compression springs are used, the first cavity and the second cavity may provide the additional advantage that a larger compression spring may be used, thereby allowing a wider choice of compression springs. When using compression springs, the first and second stop may aid in preventing damage or wear to the compression springs.

In yet another embodiment of the clamping system, at least one of the clamping element and the actuating member is provided with an engagement surface for engaging the other of the clamping element and the actuating member, wherein at least a part of the engagement surface is inclined with respect to a direction of movement of the respective element.

Such an inclined engagement surface provides a transmission between the clamping element and the actuating member, so that the clamping element and the actuating member may be placed at an angle with respect to each other, which in turn allows a relatively compact construction of the clamping system.

An angle at which the engagement surface is inclined may be chosen to select a suitable transmission ratio between movement of the actuating member and the clamping element. The angle may even vary, smoothly or abruptly, over the engagement surface, so as to provide a different transmission ratio at different positions of the engagement surface. In particular, the engagement surface may be curved, or comprise two sections with a different angle of inclination.

In yet another embodiment of the clamping system the actuating member comprises a piston of a hydraulic or pneumatic actuation system.

Accordingly, the first biasing member can act directly on said piston, which allows a very direct transfer of force from the first biasing member onto the respective hydraulic or pneumatic fluid.

In yet another embodiment of the clamping system the actuating member extends at least partly in a third cavity in the elongate beam.

By providing a cavity in the elongate beam for the actuating member, the clamping system may be constructed compactly.

Said cavity in the elongate beam is referred to as third cavity only to distinguish it from the first and second cavities. Thus, it is not implied or excluded there is more than one cavity in the elongate beam by usage of the word 'third'. The first and/or second and/or third cavities need not have anything in common apart from being cavities in their respective parts.

In yet another embodiment of the clamping system the third cavity is integrally formed in the elongate beam.

Integrally forming the cavity in the elongate beam prevents the need for a separate part for the cavity, which would have to be fixed and sealed against the elongate beam. As such a seal may present a risk of leaking or failing, the integrally formed third cavity reduces the probability of leaking or failing. Moreover, the separate part would introduce an additional source of error in mutually positioning parts of the press brake, in particular in positioning the cavity with respect to the clamping element.

Additionally or alternatively, forming the cavity integrally in the elongate beam may make production of the clamping system more cost efficient.

The invention also relates to a press brake comprising at least one clamping system as described above. The clamping system may have any of the above-described features, alone or in any suitable combination.

The clamping system may be arranged in a top beam of the press brake, in a bottom beam of the press brake, or in both. The clamping system may be a separate, exchangeable clamping system, often referred to into the art as clamping beam, or may be an integral part of the press brake.

BRIEF DESCRIPTION OF THE DRAWINGS

The invention will be further elucidated with reference to the attached drawings, in which:

FIGS. 3B, 3C, 5, 6, 7B, 7C, 8, 9 and 12 show views from the same side as that of FIGS. 1A and 2A.

In the figures, like elements are referred to with like reference numerals. Corresponding elements of different embodiments are referred to with reference numerals increased by a multiple of one hundred (100).

DETAILED DESCRIPTION

Figure 1A:
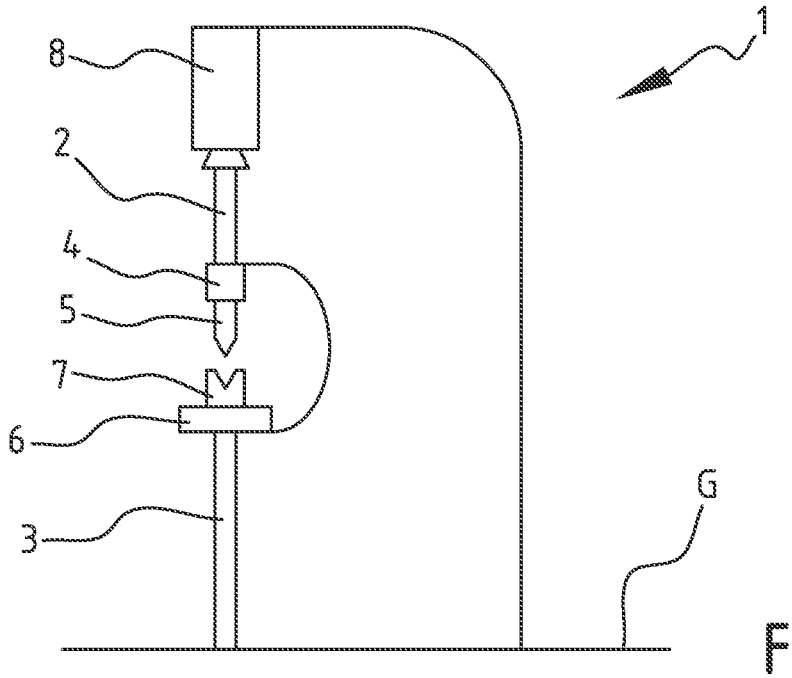
FIGS. 1A and 1B show schematically a cross-sectional side view and a front view respectively of a press brake with an exchangeable clamping system.
Figure 1B:
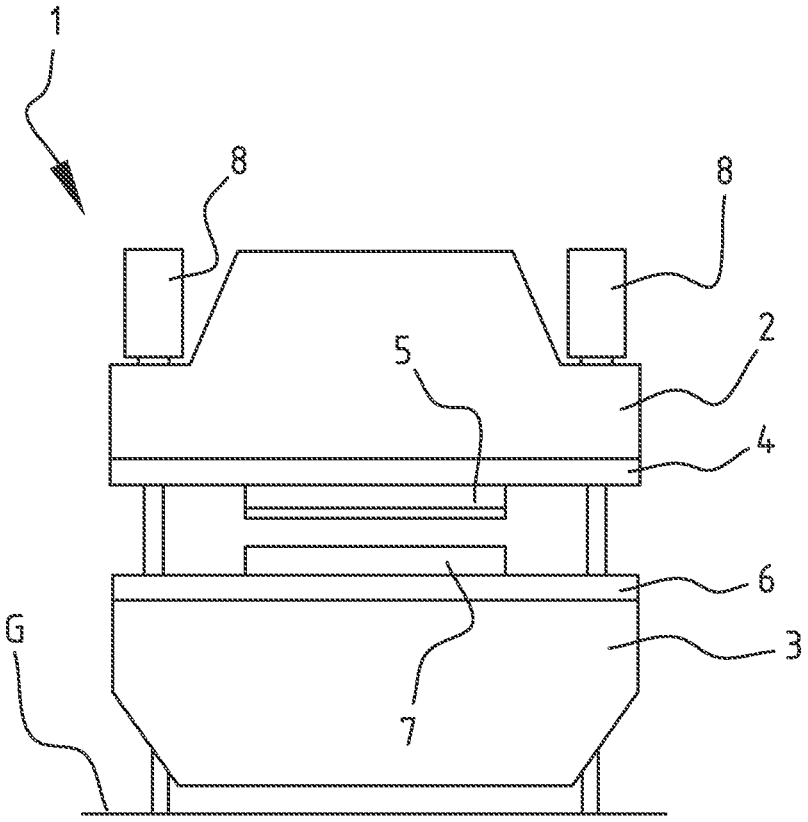

FIGS. 1A and 1B show a press brake 1 placed on a ground surface G. The press brake 1 includes a top beam 2 and a bottom beam 3. The top beam 2 is provided with a top clamping system 4. The clamping system releasably holds a top tool 5. The bottom beam 3 is provided with a bottom clamping system 6, which releasably holds a bottom tool 7. The top beam 2 and the bottom beam 3 are moveable towards and away from each other by means of hydraulic systems 8. Accordingly, the top and bottom tools 5, 7 are also moveable towards and away from each other. To bend sheet metal, the sheet is inserted between the tools 5, 7 which are then moved towards each other. The top tool 5 then forces the sheet metal into the bottom tool 7 in order to deform the sheet metal by bending. After bending, the tools 5, 7 are moved away from each other by moving the top beam 2 via the hydraulic systems 8. The clamping systems 4, 6 are releasably attached to the top and bottom beam 2, 3 respectively via a suitable locking system. Accordingly, the clamping systems 4, 6 can be exchanged for clamping systems suitable for other tools, or the clamping systems 4, 6 can be taken out for servicing them.

Figure 2A:
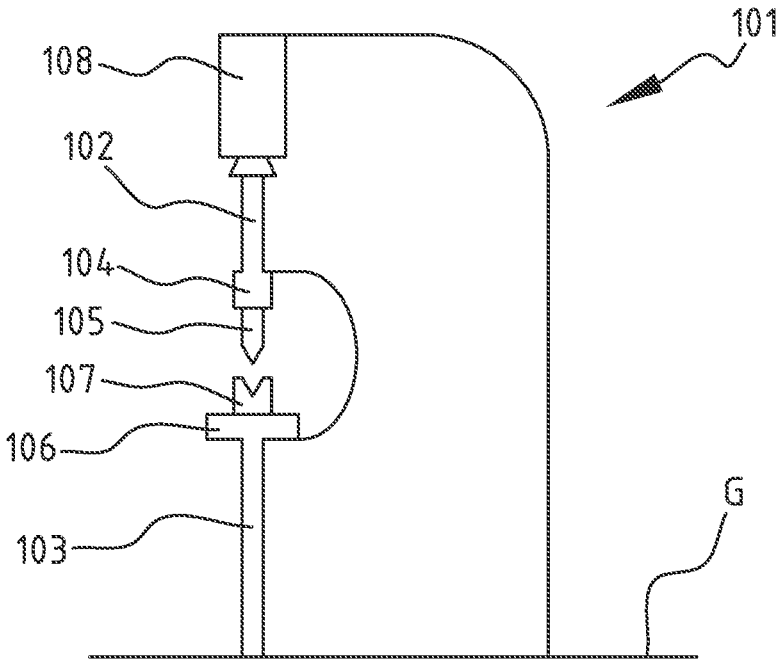
FIGS. 2A and 2B show schematically a cross-sectional side view and a front view respectively of a press brake with an integrated clamping system.
Figure 2B:
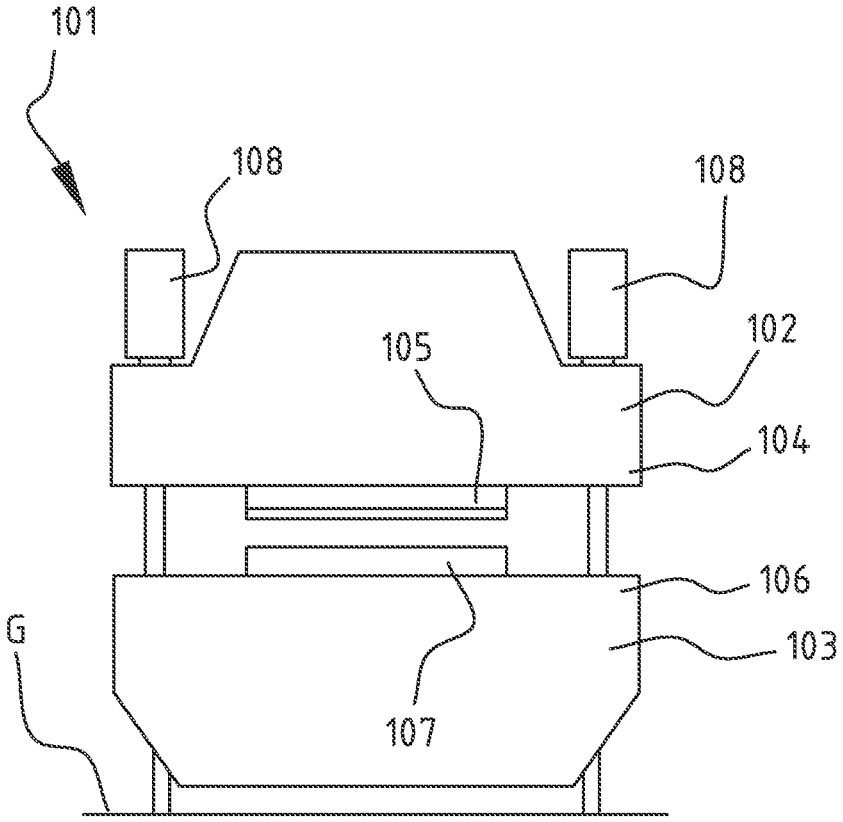

FIGS. 2A and 2B show a similar press brake 101, which will be described here only in as far as it differs from the press brake 1 in of FIGS. 1A and 1B. The clamping systems 104, 106 of the press brake in FIGS. 2A and 2B are integrated with the top and bottom beams 102, 103 respectively. As such, the clamping systems 104, 106 are not exchangeable. The tools 105, 107 held by the clamping systems 104, 106 are exchangeable.

Figure 3A:
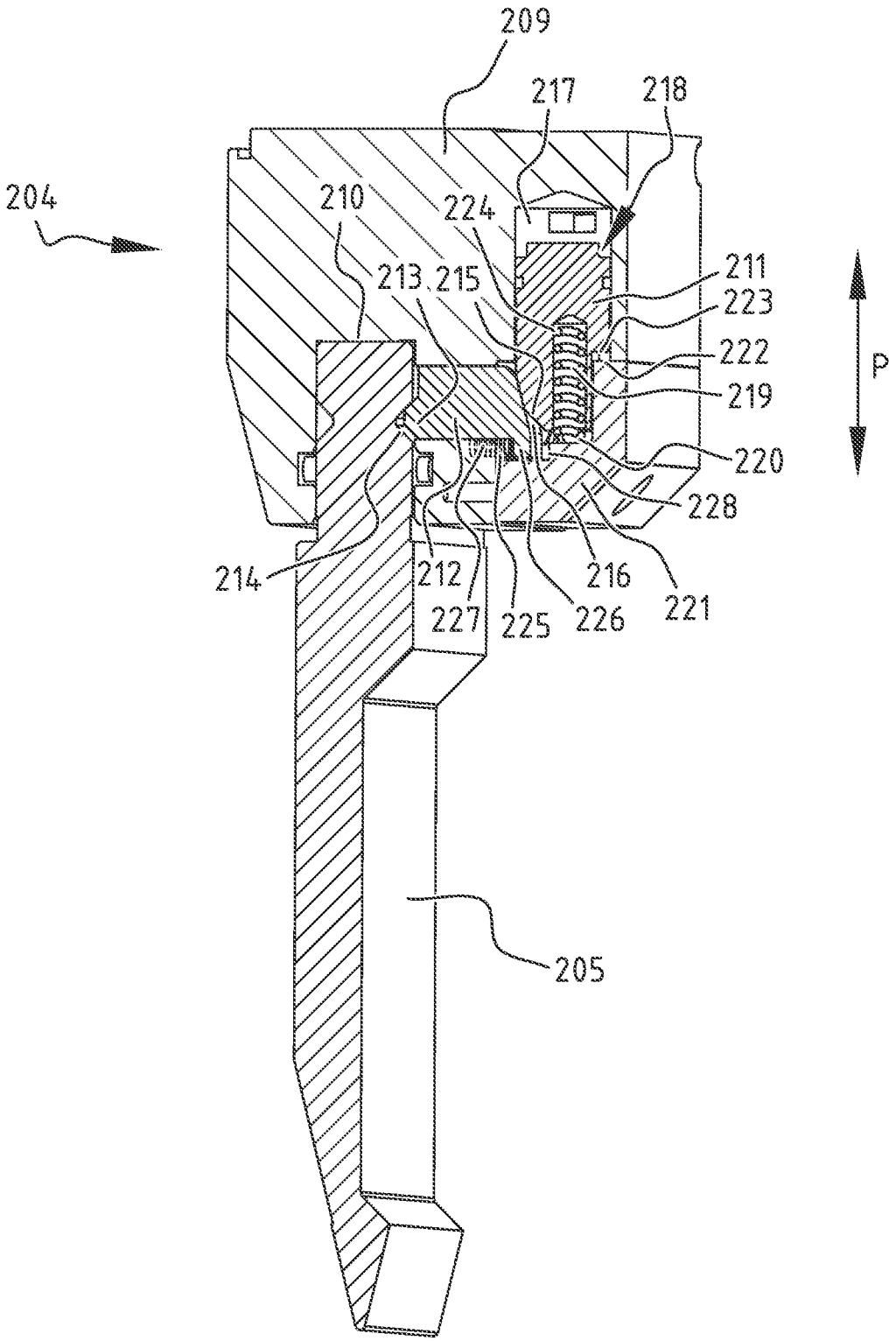
FIGS. 3A-3C show schematically a clamping system and a tool in perspective and transversal cross-sectional views.
Figure 3B:
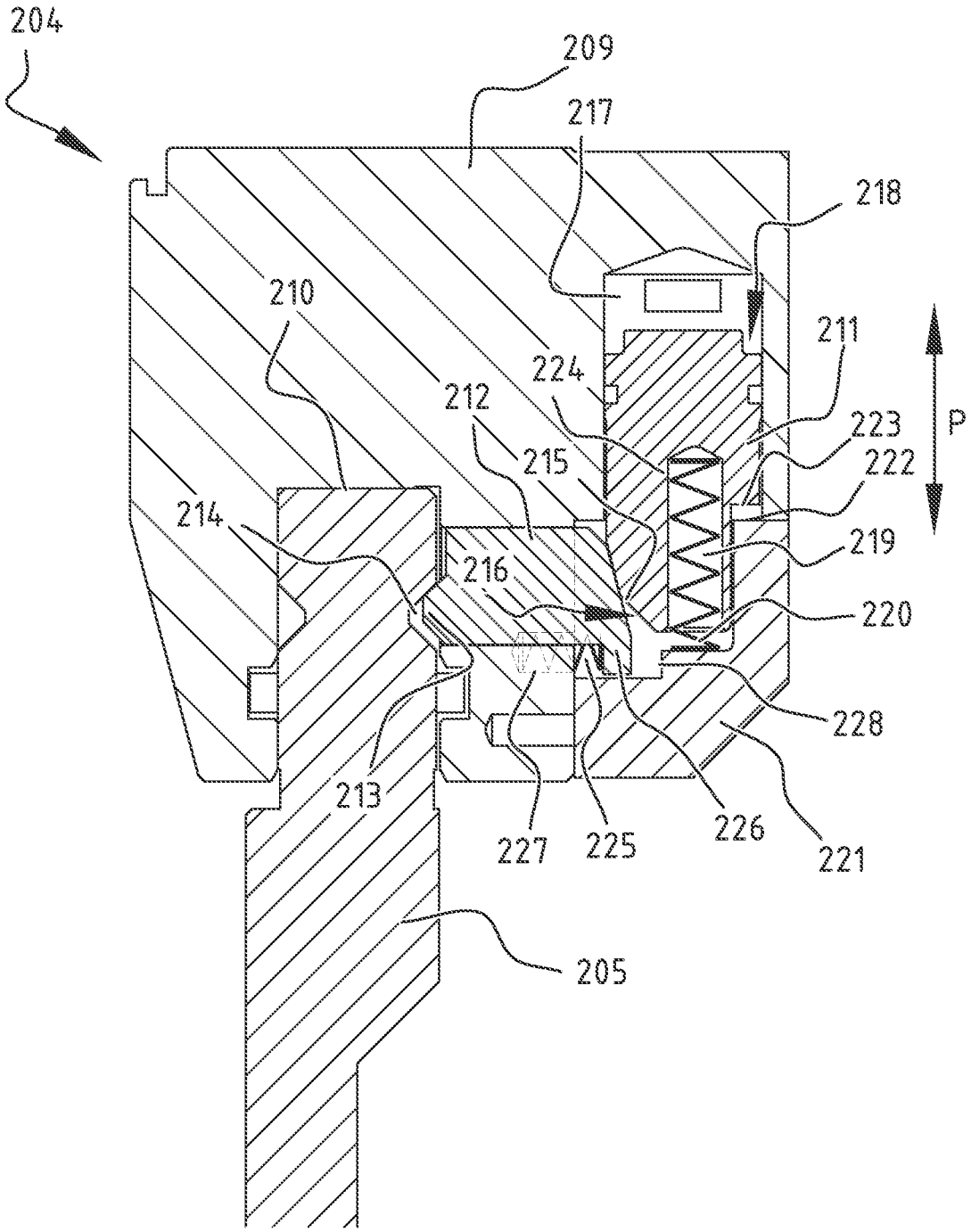
Figure 3C:
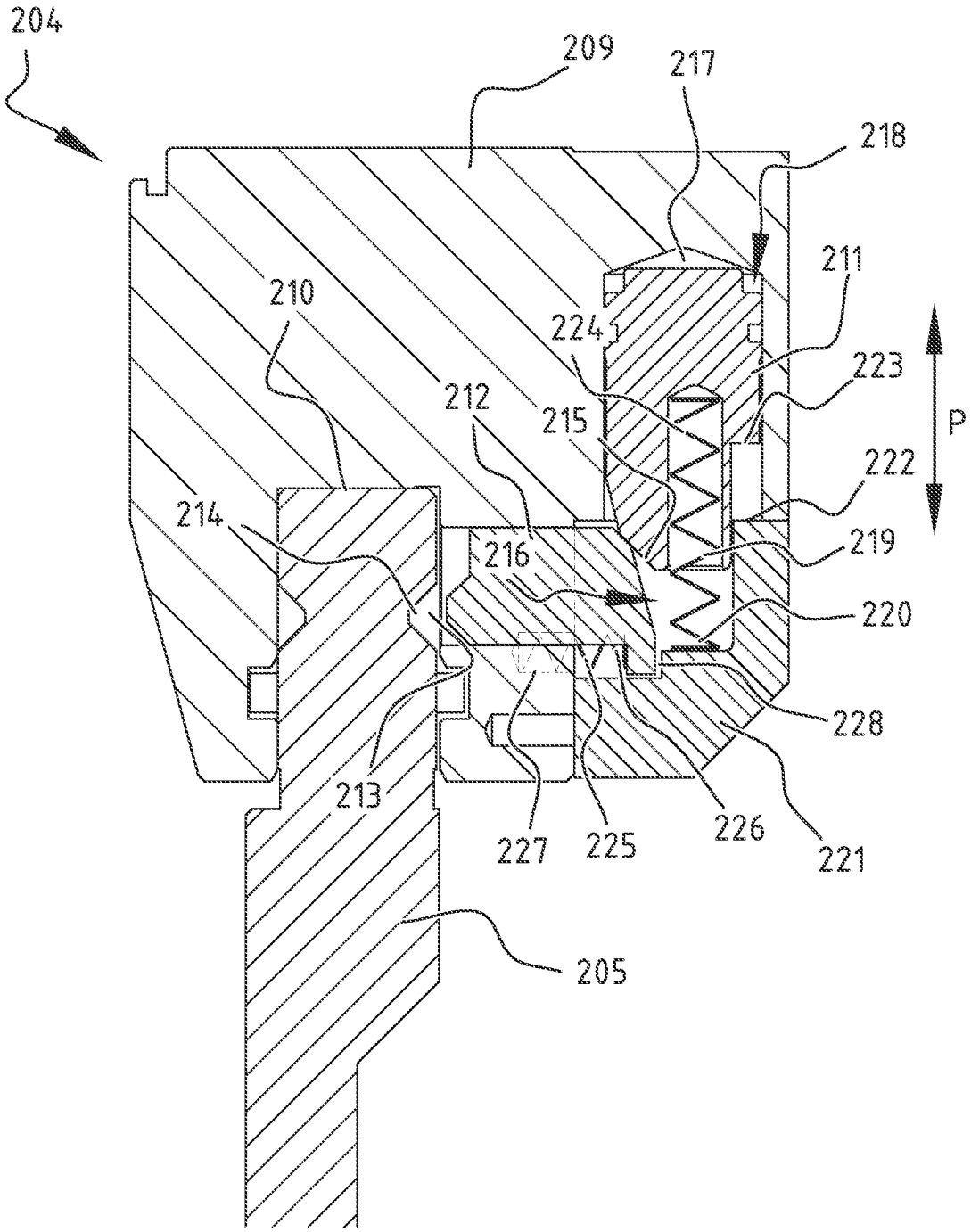

FIGS. 3A-3C show a clamping system 204, that could for instance be used in a press brake shown in FIGS. 1A-2B. The clamping system 204 has as a main body an elongate beam 209. A receiving space 210 in the elongate beam 209 accommodates a part of tool 205. The clamping system further comprises an actuating member 211 and a clamping element 212. The actuating member 211 is moveable upwards, to an inactive position, and downwards, to an active position. The clamping element 212 is moveable between a first position, in which it extends into the receiving space 210 for engaging on the tool 205, and a second position, in which it is retracted away from the receiving space 210 to release the tool. The clamping element 212 has an engaging tip 213 which cooperates with an engaging recess 214 in the tool 205 in order to clamp the tool 205 securely in the receiving space 210. In the active position, the actuating member 211 engages the clamping element 212 and urges it towards the receiving space 210. FIG. 3B shows the actuating member 211 in the active position, so that the tool 205 is clamped in the receiving space 210 by the clamping element 212. The actuating member 211 has for the purpose of engaging the clamping element 212 an inclined engaging surface 215 which engages on a similarly cooperating inclined engaging surface 216 of the clamping element 212. Accordingly, when the actuating member 211 moves to its active position, i.e. downwards in the figures, the engaging surface 215 of the actuating member 211 engages the engaging surface 216 of the clamping element 212 and, due to its inclination, urges the clamping element 212 to its first position, i.e. leftwards in the figures. FIG. 3C shows the actuating member 211 in its inactive position, with the clamping element 212 retracted away from the receiving space 210 to its second position, thereby releasing the tool 205. The actuating member 211 is movably arranged in a pressure chamber 217. The pressure chamber 217 is made directly into the elongate beam 209, which also has the receiving space 210. The pressure chamber 217 is thus integrally formed in the elongate beam 209. The actuating member 211 is provided with sealing means 218 which seal the actuating member 211 to the wall of the pressure chamber 217, i.e. to the inside of the elongate beam 209. As such, the actuating member 211 works as a piston moveable in the pressure chamber 217, which accordingly works as a cylinder. Accordingly, the actuating member 211 can be pushed towards its active position by introducing a fluid in the pressure chamber 217. The pressure chamber 217 of this clamping system 204 is adapted for receiving a hydraulic liquid as pressure fluid, in order to move the actuating member 211.

The clamping system 204 is provided with a first biasing member in the form of a first compression spring 219. The first compression spring acts on the actuating member 211. The first compression spring 219 is arranged vertically, which corresponds to the pressing direction P defined by the clamping system 204, and the depth direction of the receiving space 210. The first compression spring 219 biases the actuating member 211 upwards, i.e. towards its inactive position. Accordingly, when pressure of the hydraulic liquid in the pressure chamber 217 is stopped, the first compression spring 219 pushes the actuating member 211 upwards further into the pressure chamber 217 thereby forcing the hydraulic fluid to flow out of the pressure chamber 217. The first compression spring 219 supports on a support 220 provided by a cover 221. The cover 221 covers clamping element 212, the actuating member 211 and the pressure chamber 217. The cover 221 also forms a first stop 222 for the actuating member 211 to hit, in order to limit movement of the actuating member 211 beyond the active position. The actuating member 211 has a movement limiter 223 for engaging the first stop 222. The first compression spring 219 extends partly in a first cavity 224 in the actuating member 211. A second biasing member is provided in the form of a second compression spring 225. The second compression spring 225 is arranged horizontally, i.e. perpendicular to the pressing direction P and a longitudinal direction of the elongate beam 204. The second compression spring 225 acts on the clamping element 212 via a protrusion 226 thereof. the first compression spring 225 extends partly in a second cavity 227 in the elongate beam. The cover 221 also provides a second stop 228 for engaging the protrusion 226 of the clamping element 212, to limit the movement of the clamping element 212 beyond its second position.

Figure 4A:
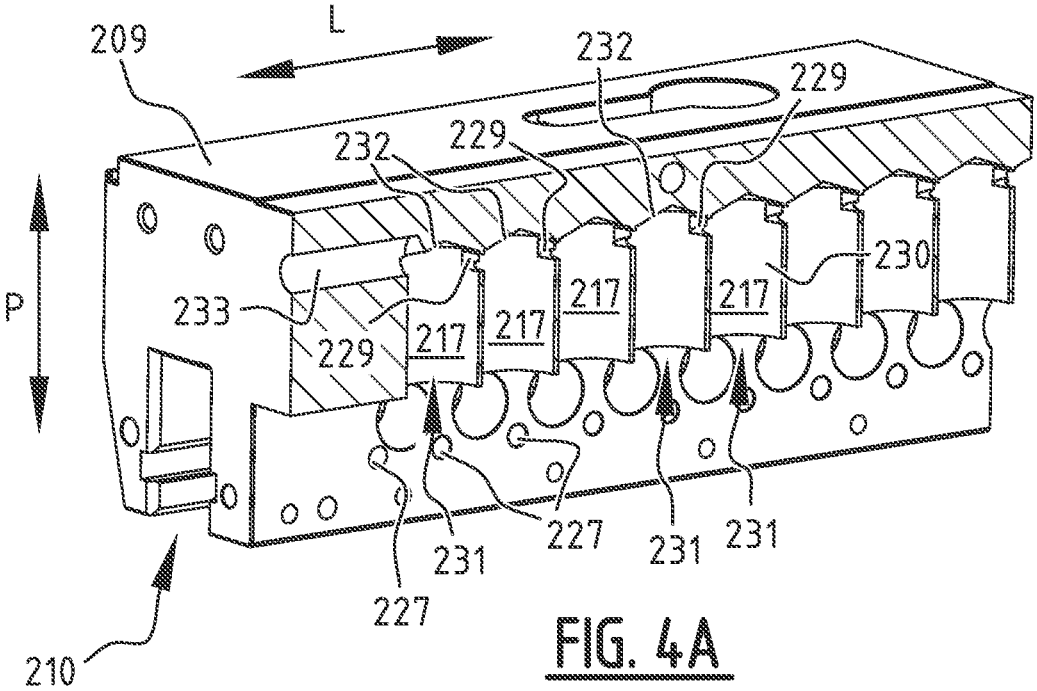
FIGS. 4A and 4B show schematically a perspective view and a longitudinal cross-sectional view of an elongate beam of the clamping system of FIGS. 3A-3C.
Figure 4B:
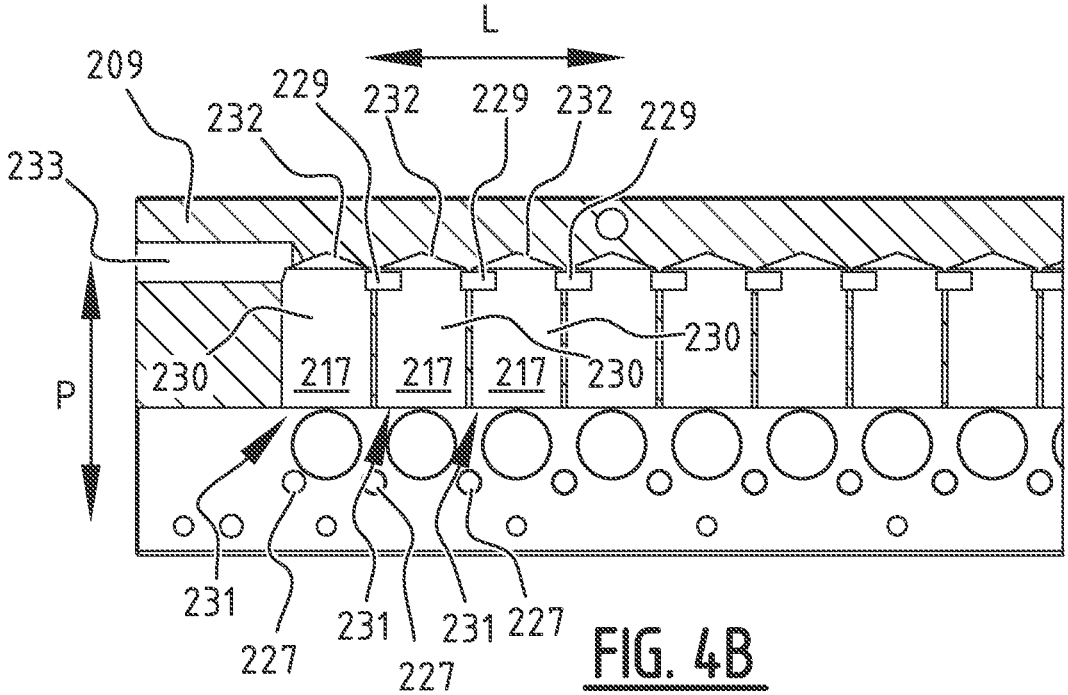

FIGS. 4A and 4B show the elongate beam 209 of the clamping system 204 described above in more detail. Repeating elements in FIGS. 4A and 4B have not been provided with reference numerals in each instance. As can be seen, multiple pressure chambers 217 are lined up in the elongate beam 209 in its longitudinal direction L. The pressure chambers 217 are connect to each other, i.e. interconnected, via interconnections consisting of channels 229 extending between side walls 230 of adjacent pressure chambers 217. The pressure chambers 217 have an opening 231 on one end, and are closed on the other end 232. The channels 229 are provided close to said other end 232. One pressure chamber 217 is connected to the external of the elongate beam 209 via a channel 233. It is visible from FIGS. 4A and 4B, that the pressure chambers 217 are arranged in the elongate beam 209 integrally, in the same piece of material comprising the receiving space 210. The pressure chambers 217 are interconnected internally, since the interconnection is made via channels 229 that do not reach the outside of the elongate beam 209.

Figure 5:
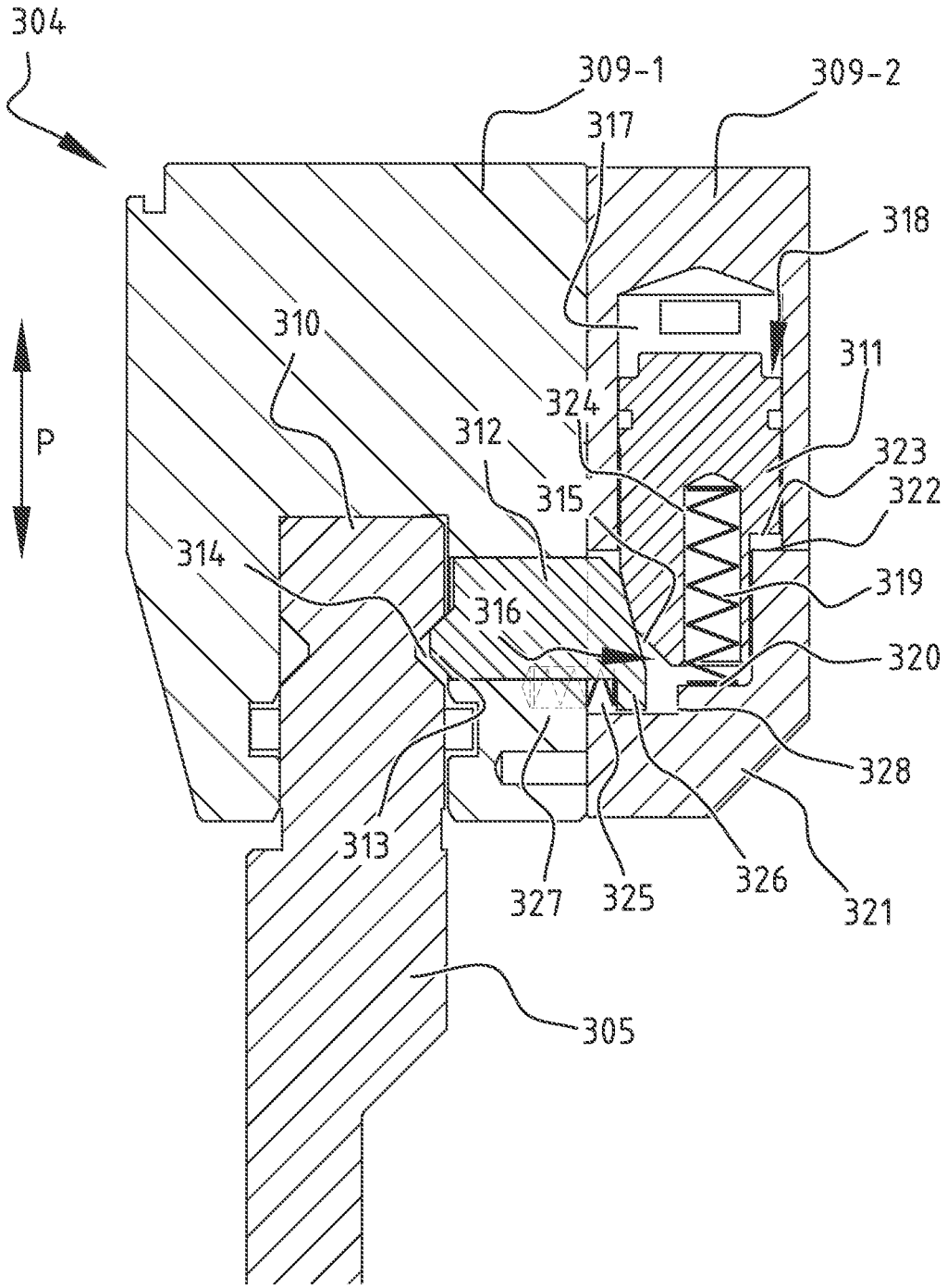
FIG. 5 shows schematically a variation on the clamping system of FIGS. 3A-5.

FIG. 5 shows a clamping system 304 that differs only from the above described clamping system 204 in that its elongate beam 309 is comprised of two separate components 309-1 and 309-2. The main body 309-1 of the elongate beam can be manufactured separate from the auxiliary body 309-2, and attached to it later. The pressure chamber 317 is formed in the auxiliary body 309-2.

Figure 6:
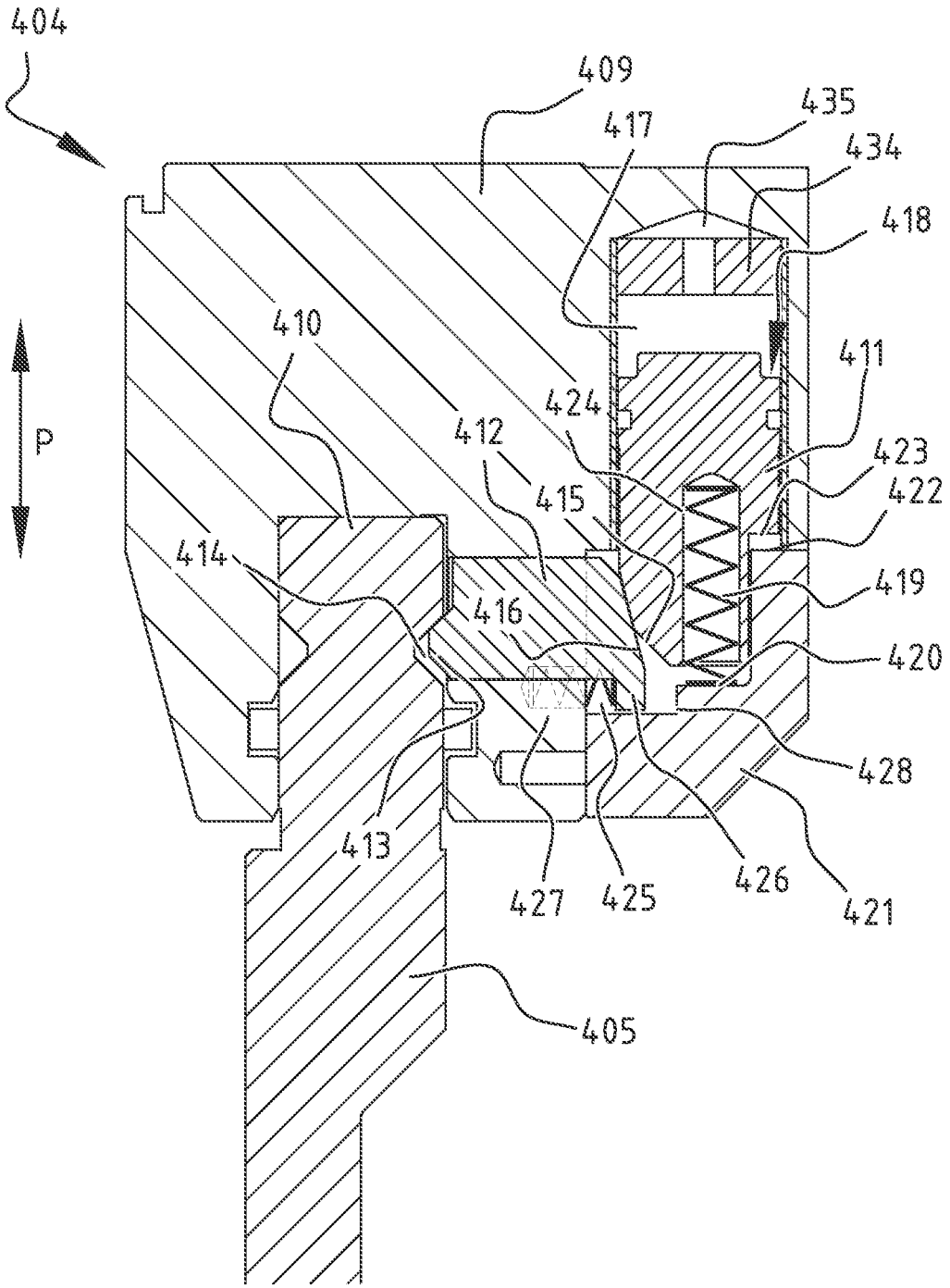
FIG. 6 shows schematically a variation on the clamping system of FIGS. 3A-5.

FIG. 6 shows a clamping system 404 that differs only from the clamping system 204 described in relation to FIGS. 3A-4B in that the pressure chamber 417 is formed within a cylinder 434 which is placed in a cavity 435 in formed integrally the elongate beam 409. It is of course possible to provide the cavity 435 in an auxiliary body as described with respect to FIG. 5, thereby combining the differing features of FIGS. 5 and 6.

Figure 7A:
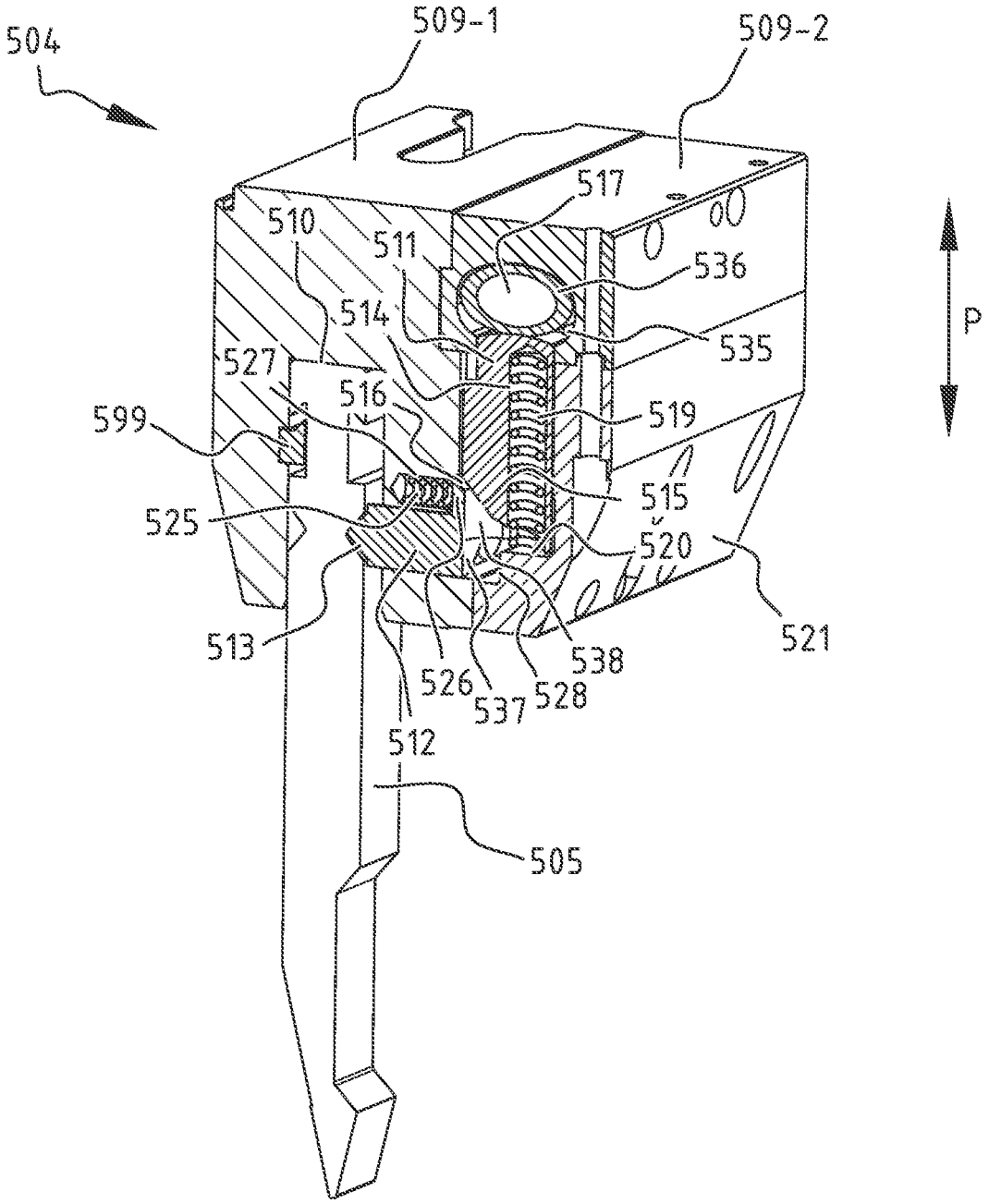
FIGS. 7A-7C show schematically another clamping system and a tool in perspective and side views.
Figure 7B:
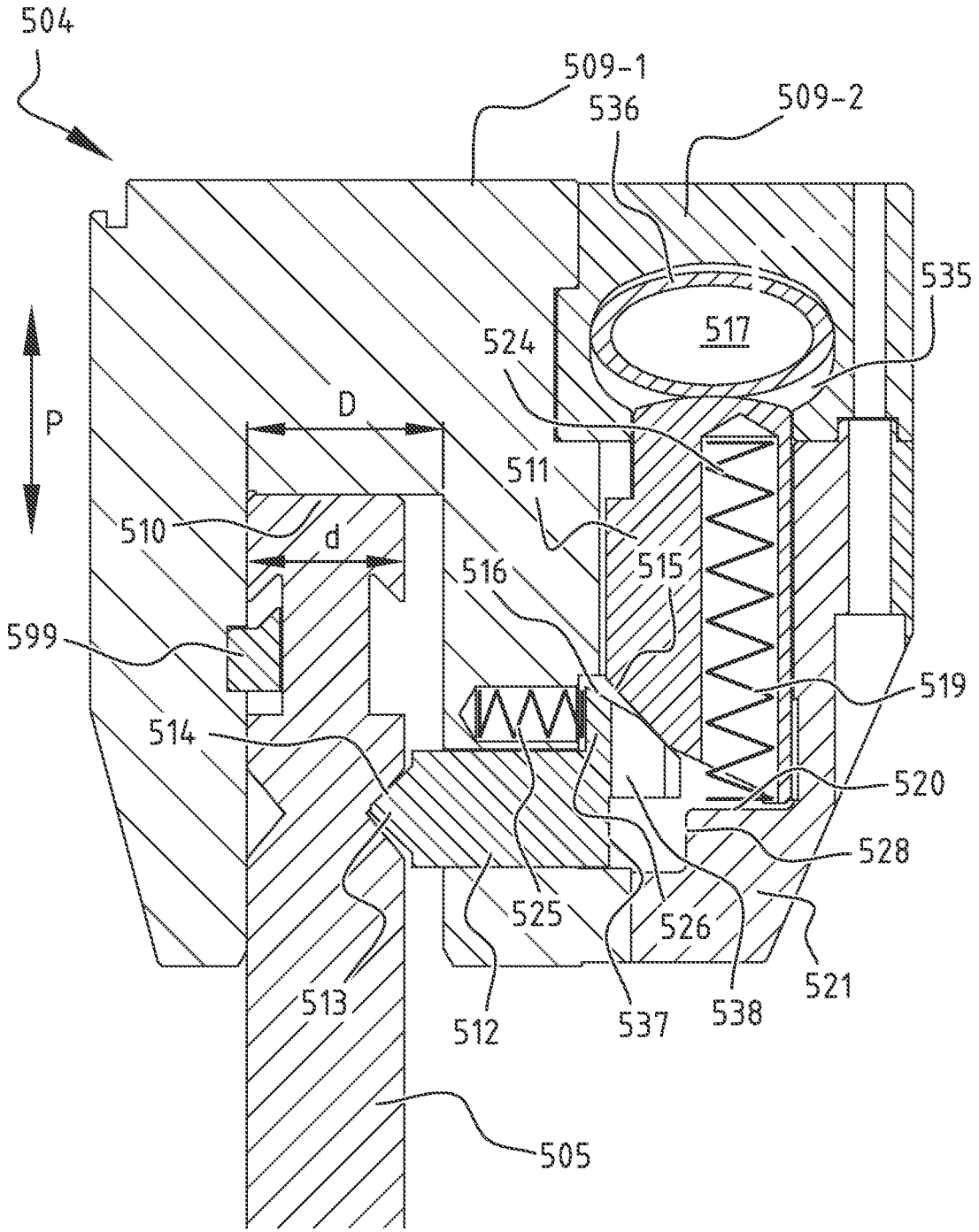
Figure 7C:
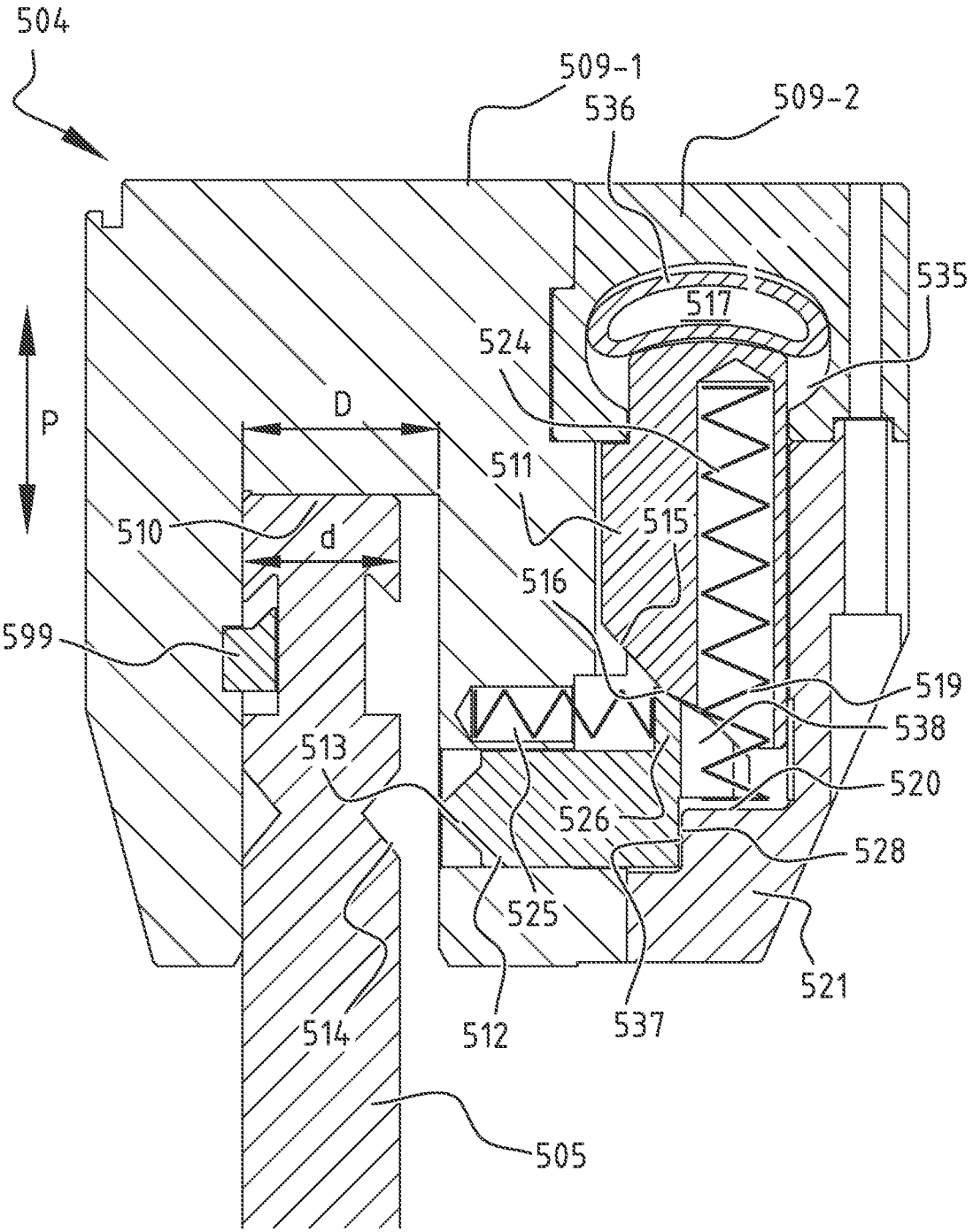

FIGS. 7A-7C show a clamping system 504 that differs only from the clamping system 204 described in relation to FIGS. 3A-4B in the features described below. Firstly, the elongate beam 509-1, 509-2 consists of two separate components 509-1 and 509-2. The main body 509-1 of the elongate beam can be manufactured separate from the auxiliary body 509-2, and attached to it later. The pressure chamber 217 is formed by a pneumatic hose 536 which has a deformable wall. The hose 536 runs in the longitudinal direction L of the elongate beam 509-1, 509-2 through a cavity 535 therein. The hose 536 expands when fluid is pressurized in the pressure chamber 517, and contracts when pressure is released. As the hose 536 expands (see FIG. 7B), it pushes the actuating member 511 to its active position. The first compression spring 519 aids in pushing fluid out of the pressure chamber 517 when pressure therein in lowered, by pushing the actuating member 511 upwards (see FIG. 7C). Moreover, the protrusion 526 of the clamping element 512 is placed on a top side of the clamping element 512 for engaging the second compression spring 525. This leaves free an end surface 537 of the clamping element 512 for engaging the second stop 528. Further, the clamping element 512 is provided with a recess 538 for accommodating the first compression spring 519 when the clamping element 512 is in the second position, i.e. moved towards the right in the figures. No first stop or movement limiter of the actuating member is provided, as was the case in the embodiment of FIGS. 3A-4B. Finally, a protrusion 599 is provided that forms a hook inside the receiving space 510. The protrusion 599 is used to hang the tool 505. For insertion or removal, the tool 505 needs to be moved around the protrusion 599. As such, the receiving space 510 has a relatively large width D as compared to the tool 505 which has a smaller width d. Accordingly, the clamping element 512 has a relatively large stroke for clamping the tool 505.

Figure 8:
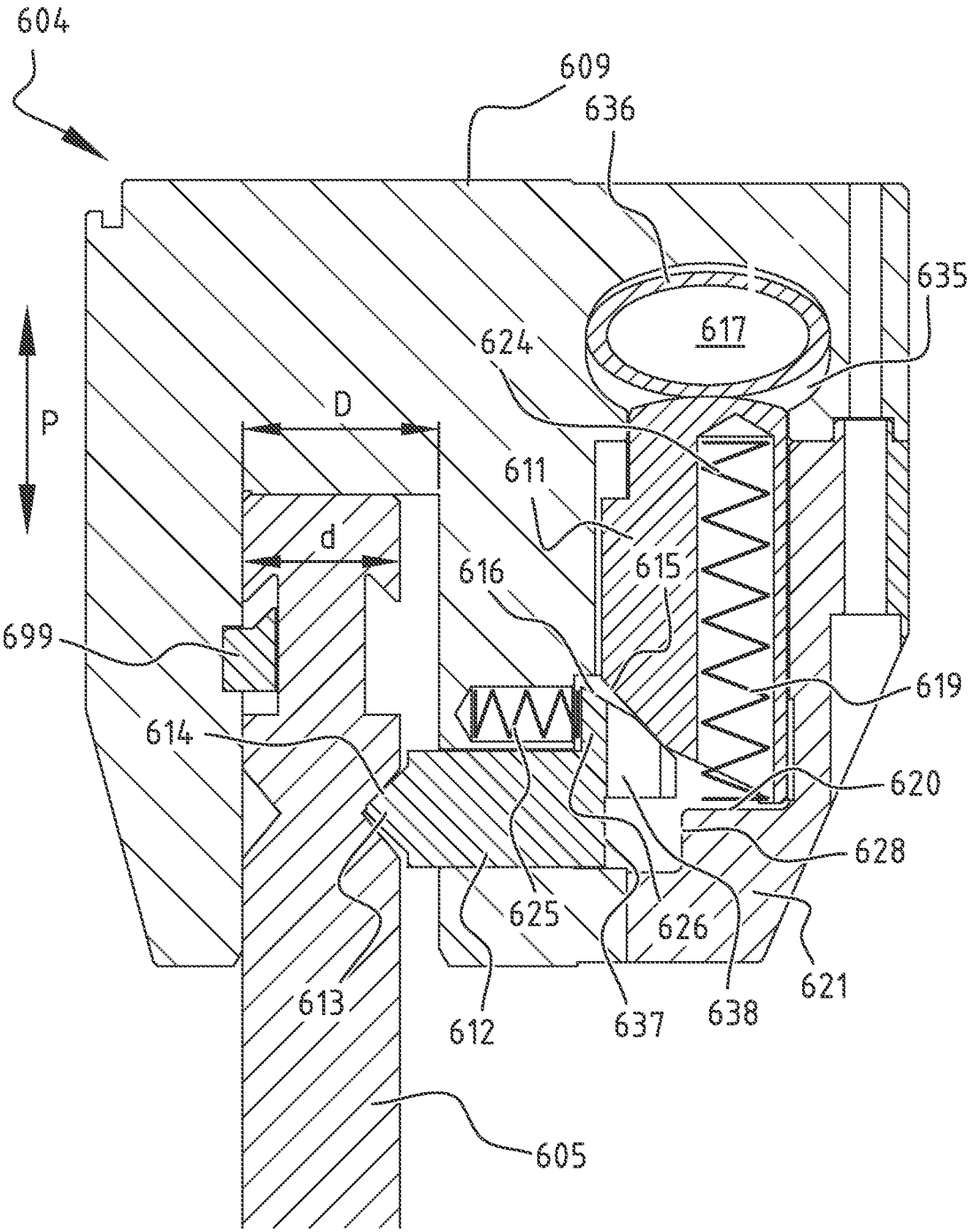
FIG. 8 shows schematically a variation on the clamping system of FIGS. 7A-7C.

FIG. 8 shows a clamping system 604 that differs from the clamping system 504 of FIGS. 7A-7C in that the elongate beam 709 is made of one piece of material. Accordingly, the cavity 635 is formed integrally in that one piece of the elongate beam 609.

Figure 9:
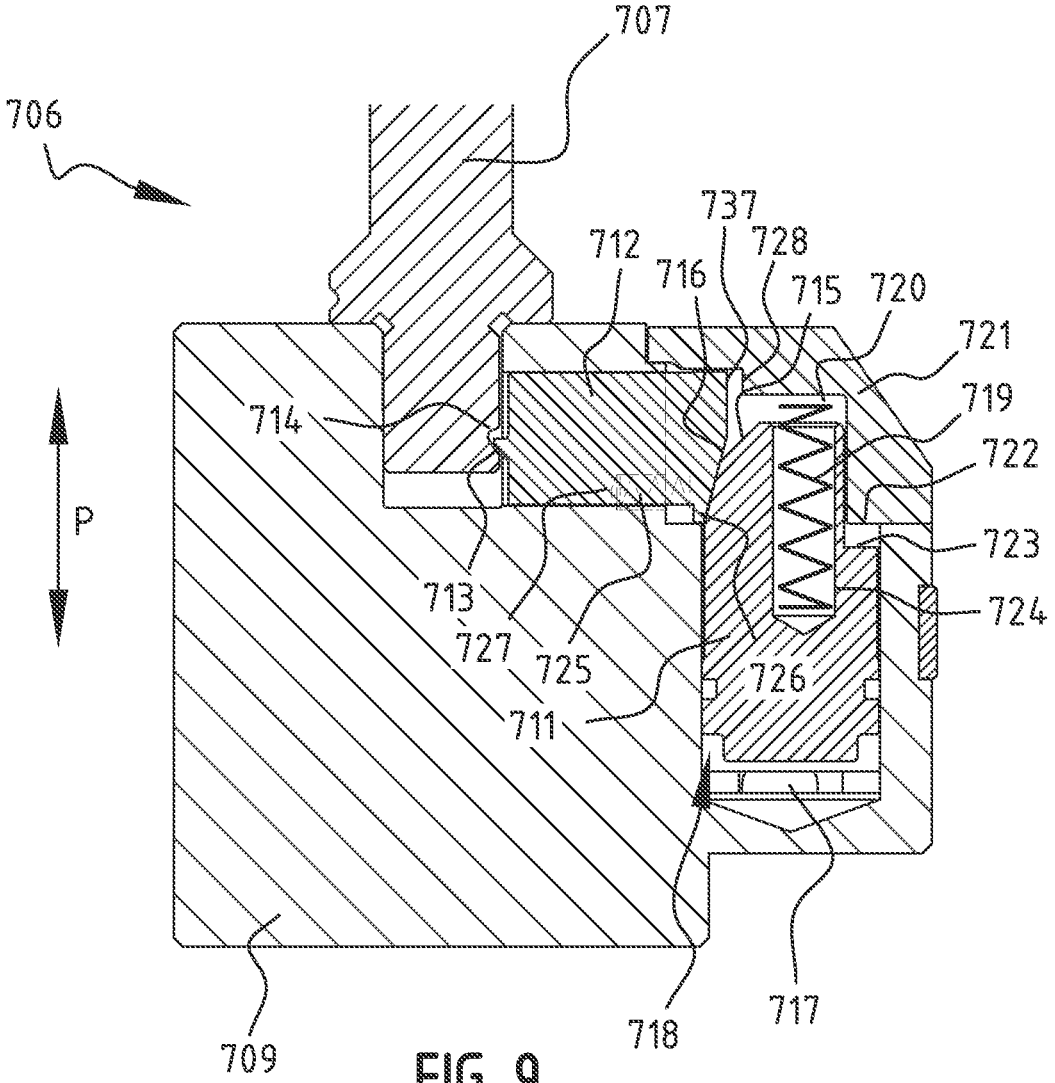
FIG. 9 shows schematically a transversal cross-sectional view of yet another clamping system.

FIG. 9 shows a bottom clamping system 706, that has the features of the clamping system 204 described in relation to FIGS. 2A-3B, apart from a different position of the protrusion 725 of the clamping element 712. The protrusion 726 leaves free an end surface 737 to cooperate with the second stop 728.

Obviously, the bottom clamping system 706 could be altered by applying any of the features described above, such as the separate elongate beam and/or the separate cylinder in the cavity and/or the hose as a pressure chamber.

Figure 10A:
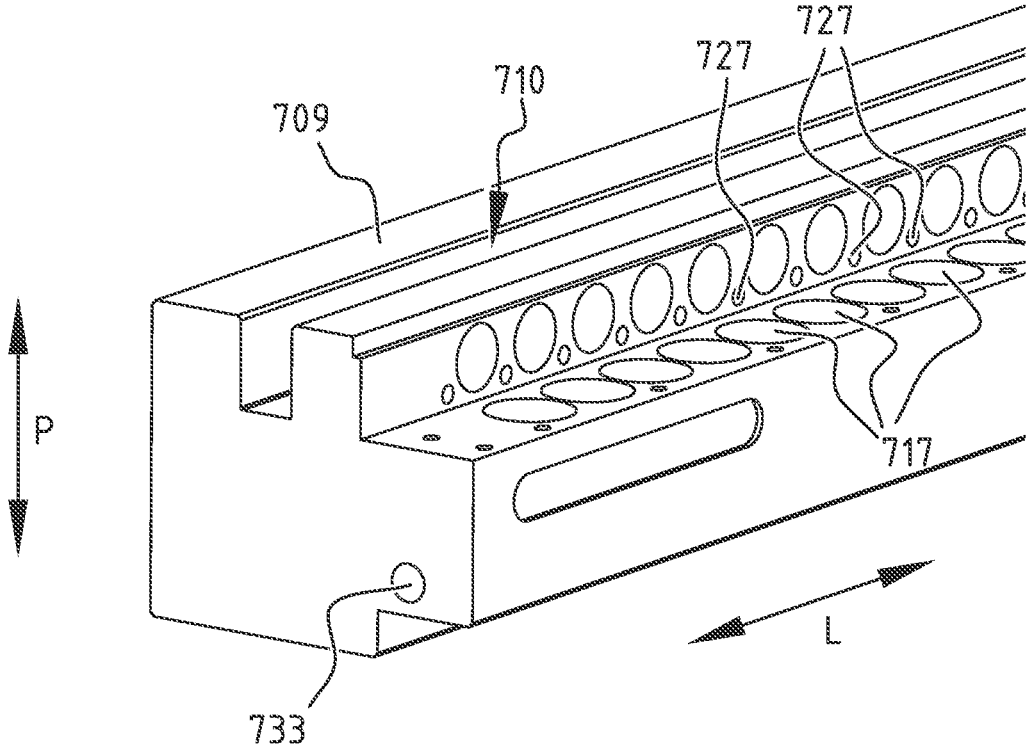
FIGS. 10A and 10B show schematically a perspective view of an elongate beam of the clamping system of FIG. 9 and of a longitudinal cross-sectional thereof.
Figure 10B:
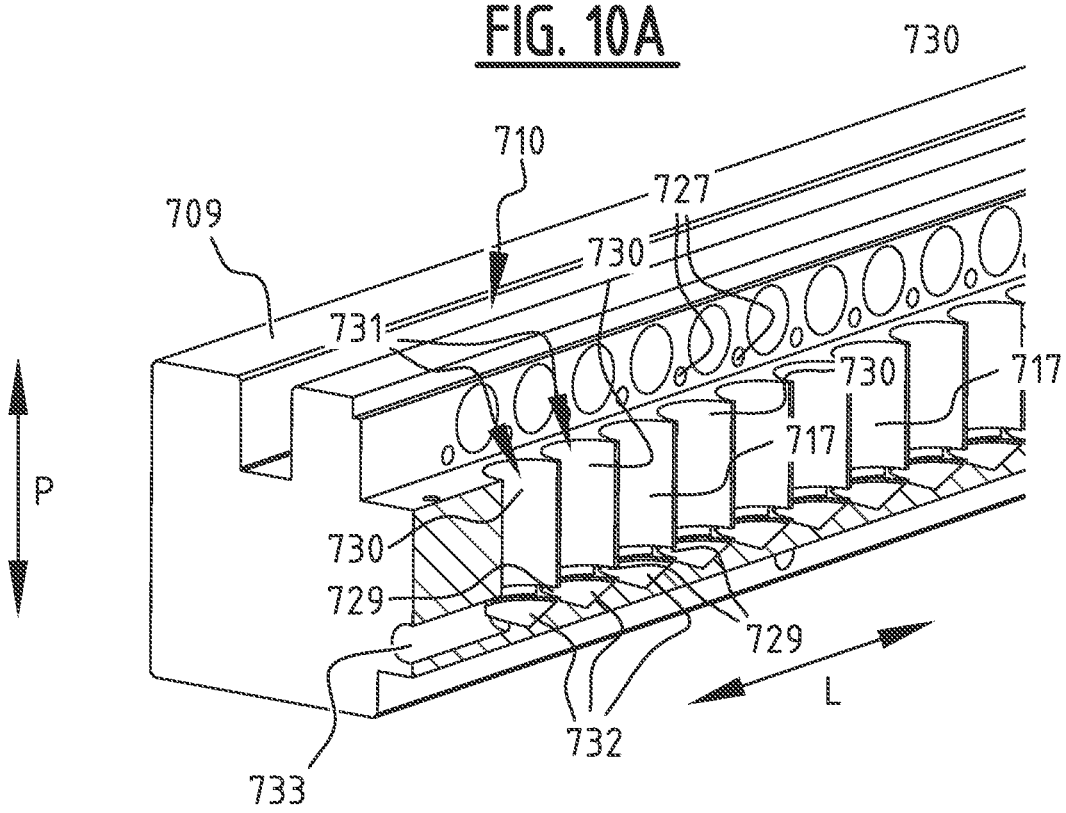

FIGS. 10A and 10B show the elongate beam 709 in more detail. Its features are similar to those described in relation to FIGS. 3A and 3B.

Figure 11A:
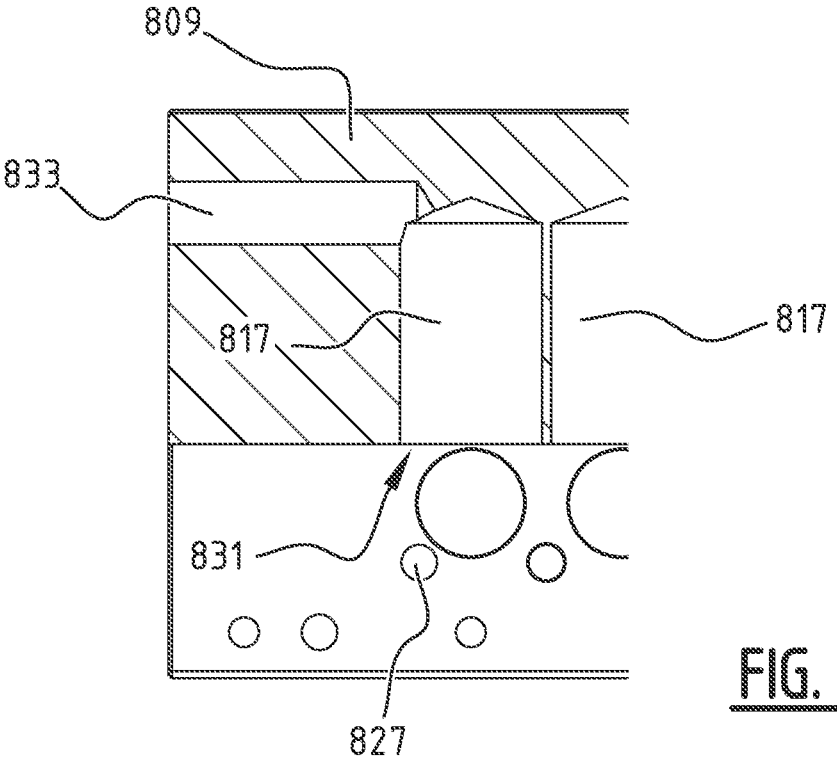
FIGS. 11A-11D show schematically steps in a method of interconnecting cavities in an elongate beam.
Figure 11B:
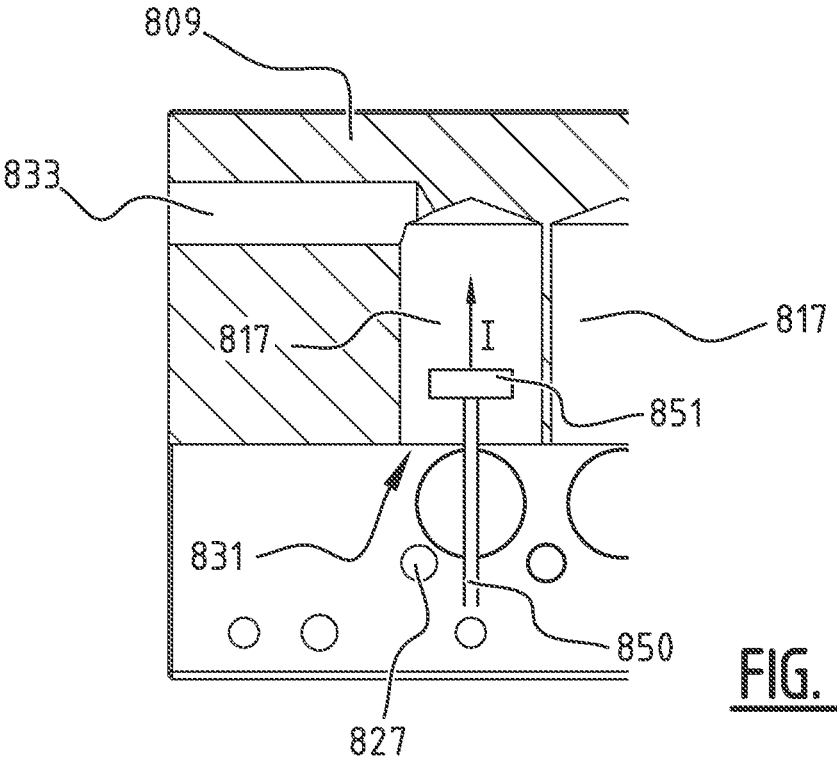
Figure 11C:
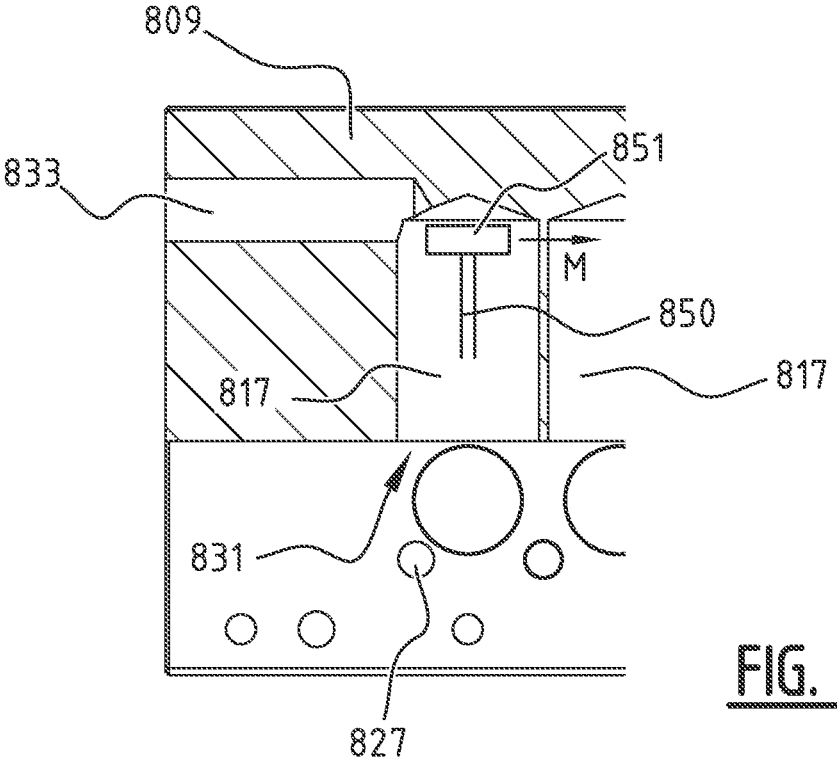
Figure 11D:
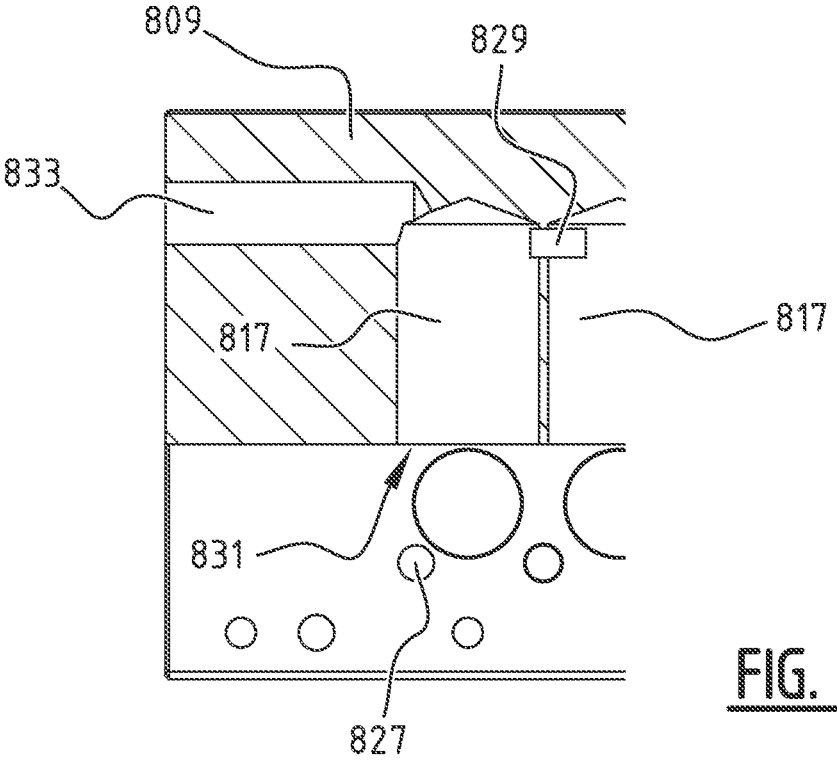

FIGS. 11A-11D show how cavities 817 in an elongate beam 809 can be interconnected internally. First, an elongate beam 809 is provided (see FIG. 11A) with cavities 817 therein. The cavities are not yet interconnected. Then (see FIG. 11B) a milling tool is inserted through the opening 831 of one cavity 817. The milling tool has a narrow stem 850 and a larger head 851. The milling tool is inserted in an insertion direction I. Then (see FIG. 11C) the milling tool is moved in a machining direction M towards another cavity 817, thereby eroding material of the elongate beam 809 and creating a channel 829 between the two cavities. As shown in FIG. 11D, the cavities 817 are thereafter interconnected.

Figure 12:
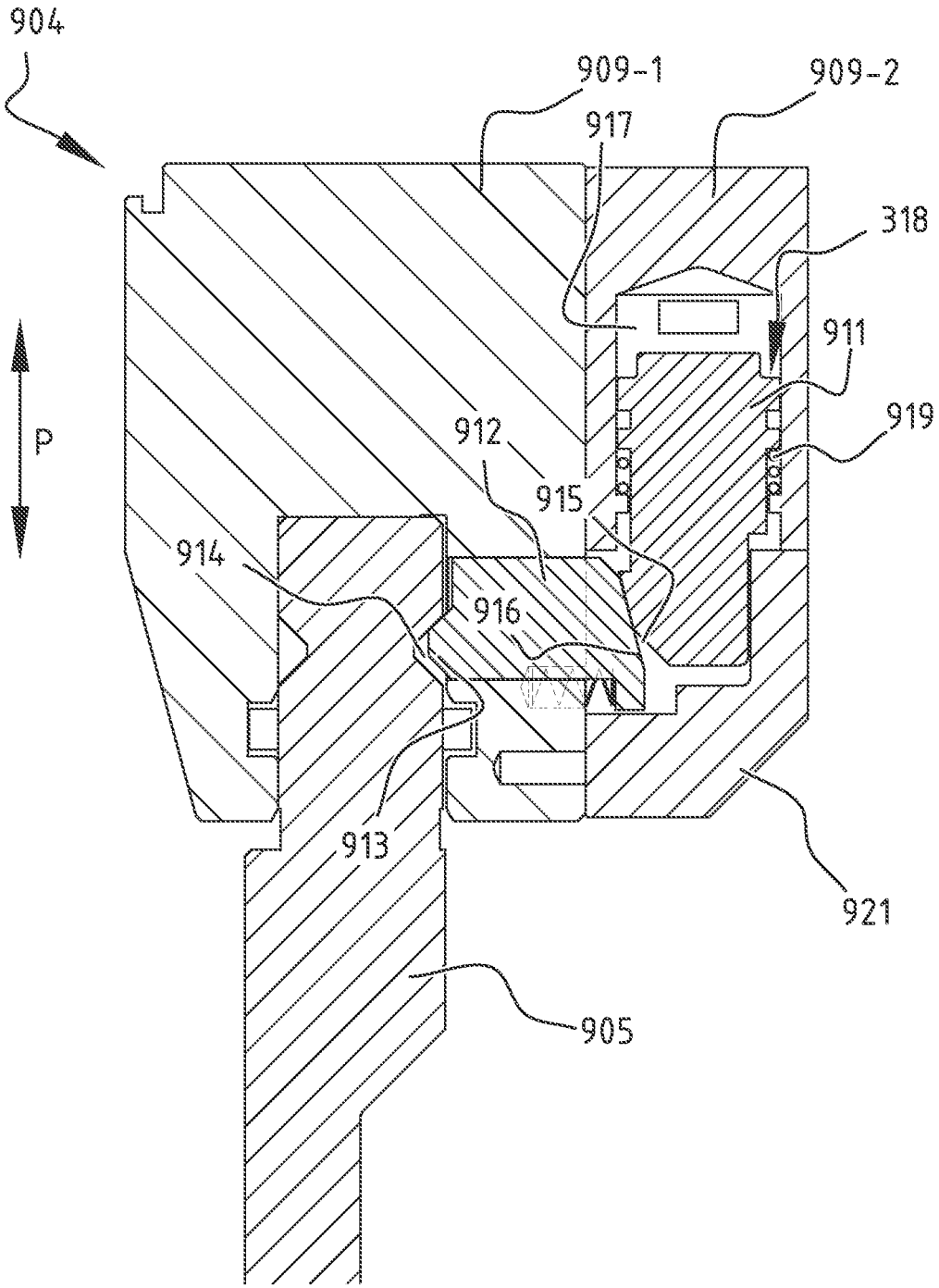
FIG. 12 shows schematically a variation on the clamping system of FIG. 5.

FIG. 12 shows yet another clamping system 904, that differs from the clamping system 304 described in relation to FIG. 5 in that the first compression spring 919 is provided around the actuating member 911 instead of in a cavity therein. No first stop has been shown in FIG. 12. The first compression spring of other clamping systems shown in this application could also be provided around their respective actuating members.

Although the invention has been described hereabove with reference to a number of specific examples and embodiments, the invention is not limited thereto. Instead, the invention also covers the subject matter defined by the claims, which now follow.

The invention claimed is:

1. A clamping system for a press brake, the clamping system comprising:

an elongate beam comprising a receiving space for receiving a part of a bending tool, the receiving space having a depth direction defining parallel thereto a pressing direction in which a tool clamped by the clamping system is received;

a clamping element, the clamping element being movable between a first position in which it may engage on the bending tool for clamping it in the receiving space, and a second position for releasing the bending tool;

an actuating member for displacing the clamping element, the actuating member being movable between an active position in which it urges the clamping element towards the first position, and an inactive position in which it allows the clamping element to move to the second position, and a first biasing member acting on the actuating member for biasing the actuating member towards its inactive position, wherein the first biasing member extends at least partly in a first cavity in the actuating member, or extends at least partly around the actuating member.

2. The clamping system according claim 1, wherein the first biasing member is arranged substantially parallel to the pressing direction.

3. The clamping system according to claim 1, wherein the actuating member is movable in a direction substantially parallel to the pressing direction between its active and inactive position.

4. The clamping system according to claim 1, wherein the first biasing member is arranged on a side of the actuating member proximate the clamping element.

5. The clamping system according to claim 1, further comprising a first stop for limiting movement of the actuating member beyond its active position.

6. The clamping system according to claim 1, wherein the clamping element is movable in a direction substantially perpendicular to the pressing direction and to a longitudinal direction of the elongate beam between its first and second position.

7. The clamping system according to claim 1, further comprising a second biasing member acting on the clamping element for biasing the clamping element towards the second position.

8. The clamping system according to claim 7, wherein the second biasing member is arranged substantially perpendicular to the pressing direction and to a longitudinal direction of the elongate beam.

9. The clamping system according to claim 7, wherein the second biasing member extends at least partly in a cavity provided therefor in the elongate beam.

10. The clamping system according to claim 7, wherein the clamping element comprises a protrusion for engaging the second biasing member.

11. The clamping system according to claim 1, wherein the first biasing member comprises a compression spring.

12. The clamping system according to claim 1, wherein at least one of the clamping element and the actuating member is provided with an engagement surface for engaging the other of the clamping element and the actuating member, and wherein at least a part of the engagement surface is inclined with respect to a direction of movement of the respective element.

13. The clamping system according to claim 1, wherein the actuating member comprises a piston of a hydraulic or pneumatic actuation system.

14. The clamping system according to claim 1, wherein the actuating member extends at least partly in a cavity provided therefor in the elongate beam.

15. The clamping system according to claim 14, wherein the cavity is integrally formed in the elongate beam.

16. A clamping system for a press brake, the clamping system comprising:

an elongate beam comprising a receiving space for receiving a part of a bending tool, the receiving space having a depth direction defining parallel thereto a pressing direction in which a tool clamped by the clamping system is received;

a clamping element, the clamping element being movable between a first position in which it may engage on the bending tool for clamping it in the receiving space, and a second position for releasing the bending tool;

an actuating member for displacing the clamping element, the actuating member being movable between an active position in which it urges the clamping element towards the first position, and an inactive position in which it allows the clamping element to move to the second position, and a first biasing member acting on the actuating member for biasing the actuating member towards its inactive position, further comprising a stop for limiting movement of the clamping element beyond its second position;

wherein the clamping element comprises a protrusion for engaging the second biasing member, wherein the stop engages the protrusion in the second position.

17. The clamping system according to claim 16, wherein the first biasing member is arranged substantially parallel to the pressing direction.

18. A clamping system for a press brake, the clamping system comprising:

an elongate beam comprising a receiving space for receiving a part of a bending tool, the receiving space having a depth direction defining parallel thereto a pressing direction in which a tool clamped by the clamping system is received;

a clamping element, the clamping element being movable between a first position in which it may engage on the bending tool for clamping it in the receiving space, and a second position for releasing the bending tool;

an actuating member for displacing the clamping element, the actuating member being movable between an active position in which it urges the clamping element towards the first position, and an inactive position in which it allows the clamping element to move to the second position, and a first biasing member acting on the actuating member for biasing the actuating member towards its inactive position, wherein the clamping element comprises a recess for receiving at least part of the first biasing member.

19. The clamping system according to claim 18, wherein the first biasing member is arranged substantially parallel to the pressing direction.

20. A press brake comprising a bottom beam and a top beam, which are movable with respect to each other, configured for holding tools, between which a workpiece can be provided for bending, the press brake further comprising at least one said clamping system according to claim 1 for allowing tools held by the bottom and top beams to be exchanged.

* * * * *